US007699978B2

(12) United States Patent
Dyer

(10) Patent No.: US 7,699,978 B2
(45) Date of Patent: Apr. 20, 2010

(54) TRASH SCREEN FOR SIDE ENTRY PIT

(76) Inventor: John Raymond Dyer, 5 Powell Court, West Lakes, South Australia 5021 (AU)

( * ) Notice: Subject to any disclaimer, the term of this patent is extended or adjusted under 35 U.S.C. 154(b) by 24 days.

(21) Appl. No.: 11/988,172

(22) PCT Filed: Jun. 21, 2006

(86) PCT No.: PCT/AU2006/000873

§ 371 (c)(1),
(2), (4) Date: Jan. 2, 2008

(87) PCT Pub. No.: WO2007/002984

PCT Pub. Date: Jan. 11, 2007

(65) Prior Publication Data

US 2009/0114579 A1 May 7, 2009

(30) Foreign Application Priority Data

Jul. 5, 2005 (AU) ..... 2005903551
Oct. 11, 2005 (AU) ..... 2005905588

(51) Int. Cl.
*E03F 5/046* (2006.01)
*E03F 5/06* (2006.01)

(52) U.S. Cl. ..... 210/131; 210/156; 210/163; 404/4

(58) Field of Classification Search ..... 210/155, 210/156, 160, 162, 163, 164, 170.03, 434, 210/499, 131; 404/4, 5
See application file for complete search history.

(56) References Cited

U.S. PATENT DOCUMENTS

| | | | | | |
|---|---|---|---|---|---|
| 506,267 | A * | 10/1893 | Sefton | 210/163 |
| 783,556 | A * | 2/1905 | Van Buskirk | 210/163 |
| 1,245,903 | A * | 11/1917 | Gross | 210/163 |
| 3,093,578 | A * | 6/1963 | Hofmeister | 210/160 |
| 4,594,157 | A | 6/1986 | McGowan | |
| 5,232,587 | A * | 8/1993 | Hegemier et al. | 210/162 |
| 5,300,221 | A * | 4/1994 | Austevoll | 210/155 |
| 5,387,336 | A * | 2/1995 | Bormet et al. | 210/160 |
| 5,954,952 | A | 9/1999 | Strawser, Sr. | |
| 6,015,489 | A | 1/2000 | Allen et al. | |
| 6,017,166 | A | 1/2000 | Mossburg, Jr. | |
| 6,368,499 | B1 * | 4/2002 | Sharpless | 210/164 |
| 2003/0173277 | A1 | 9/2003 | Shaw et al. | |
| 2004/0069697 | A1 | 4/2004 | Martinez | |
| 2004/0094461 | A1 * | 5/2004 | Sharpless | 210/163 |
| 2004/0173513 | A1 | 9/2004 | Nino | |
| 2004/0200767 | A1 | 10/2004 | Singleton | |
| 2006/0091049 | A1 * | 5/2006 | Hurst et al. | 210/163 |

* cited by examiner

*Primary Examiner*—Christopher Upton
(74) *Attorney, Agent, or Firm*—The Nath Law Group; Jerald L. Meyer; Stanley N. Protigal

(57) ABSTRACT

A protection device for a side entry pit, device having a frame to clamp to the exposed edge of the cover of the pit, and a screen of chains attached to the frame and extending beneath the opening of the pit to prevent trash from entering the pit. The protection device also includes a screen to prevent debris such as dirt and gravel entering the pit, the device including a wire mesh supporting a material such as filter foam to prevent the debris entering the pit, while permitting the passage of water therethrough.

14 Claims, 4 Drawing Sheets

TRASH SCREEN FOR SIDE ENTRY PIT

This invention relates to a trash or debris screen to prevent the entry of trash into stormwater or run-off water drains, sewers, channels and the like, more particularly to the prevention of the entry of rubbish into a side entry pit situated in the kerbing of a roadway.

BACKGROUND TO THE INVENTION

It is well known the litter but not limited to paper, packages, food containers, food wrappers, and leaves are washed down into waste water drainage systems and thus enter creeks, rivers, reservoirs, designed wet lands, and the ocean during and after periods of rains. Leaves are often a great source of the litter, especially where deciduous trees are planted along roadways, and especially when the first winter rains fall immediately after autumn. A large proportion of this water drainage is from roadways. The water runs off the roadway into the kerb (curb) or gutter, openings being provided at selected points along the gutter or kerb for the water to drain into the drainage system.

The openings are provided to direct the water to a drainage pit, the openings being either in the bottom of the gutter, or in the sidewall of the gutter or kerb. The opening in the bottom of the gutter is covered by a grid which prevents the majority of the trash entering the pit. However the opening for the side entry pit is open and all trash can be washed into the pit.

Various attempts have been made to overcome the problem, these including screens and baskets as in registered designs 147248 to 147268, filters as in U.S. Pat. No. 6,709,579, JP2004285819, AU2002100292, and removable drain filter as described in AU20007203.

However with a side entry pit it would be preferable if some form of screening can be utilised to prevent the entry of the trash into the drainage pit. However the screen must be such that it still permits a vehicle wheel to roll in the gutter and permit a street sweeper to pass in front of the side entry pit.

Also side entry pits have the pit under the edge of the footpath, lawn, or verge of the construction adjacent the roadway, the pit being closed by one or more cover plates, usually of concrete, having a channel shaped metal member surrounding the cover plate.

Thus there is a need to provide a temporary barrier to the entry of solid or heavy materials and debris being washed into a side entry pit. It is desired also that the temporary barrier be anchored so that it is not liable to be washed out of position.

BRIEF STATEMENT OF THE INVENTION

Thus there is provided according to the invention a trash catch skirt for a side entry pit, the skirt including an attachment for attaching the skirt to the edge of the cover plate on the side entry pit, the attachment having depending there from a plurality of flexible screening members.

Preferably the attachment member is an adjustable bracket attached to the edge of the cover plate, the bracket supporting a plurality of chain links extending over the opening to the side entry pit.

Preferably the bracket supports a steel rod from which the chain links depend.

Further more the plurality of chain links may be cross linked to maintain their location.

However while the chain skirt prevents rubbish entering the side entry pit, there are times when heavy material or debris such as sand, dirt, gravel and the like is washed into the side entry pit. This often occurs at building sites and areas being developed. In these areas the services are provided before the building commences, these services including roads, curbs and drainage systems. Thus during the building operations vehicles are entering and leaving the building sites and in so doing mud, dirt and the like fall off the vehicle's wheels onto the roadway. This is then washed into the side entry pit during rain or when the roadway is washed by the civic authorities or developers.

Also there is provided according to the invention a temporary debris screen attachable to a portion of the side entry pit, said screen including a frame having brackets to be attached to the portion of the side entry pit, said frame having a portion to engage on the lower edge of the side entry pit, said portion supporting filter material to filter the debris such as sand, dirt and gravel from the water flowing through the debris screen.

The above debris screen would desirably be used adjacent building sites during the construction of buildings, however in an alternate form the debris screen to filter debris such as sand and dirt and gravel can be a temporary barrier and be attached as by hooks to the steel rod supporting the more permanent chain barrier.

BRIEF DESCRIPTION OF THE DRAWINGS

FIGS. 5 and 5*a* are a general view of the screen of FIG. 2 and the side entry pit, and FIGS. 6 and 6*a* are a general view of the screen of FIG. 3 attached to a side entry pit.

DESCRIPTION OF THE PREFERRED EMBODIMENT

Figure 1:
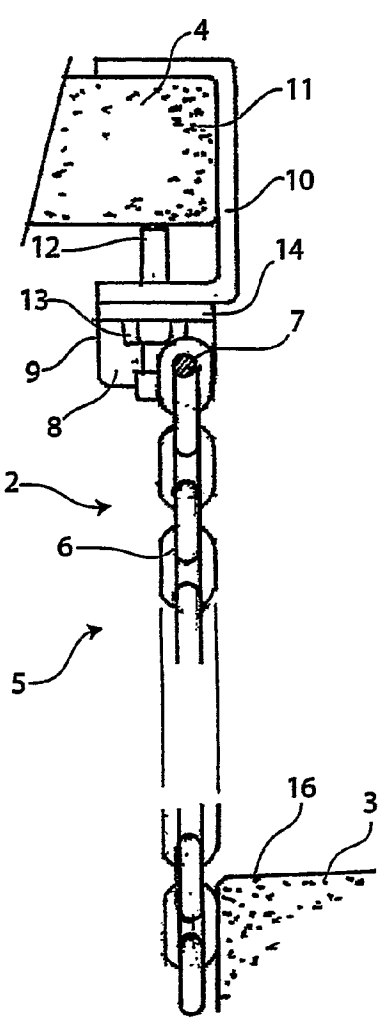
FIG. 1 is a side view of the first embodiment of the invention.
Figure 4:
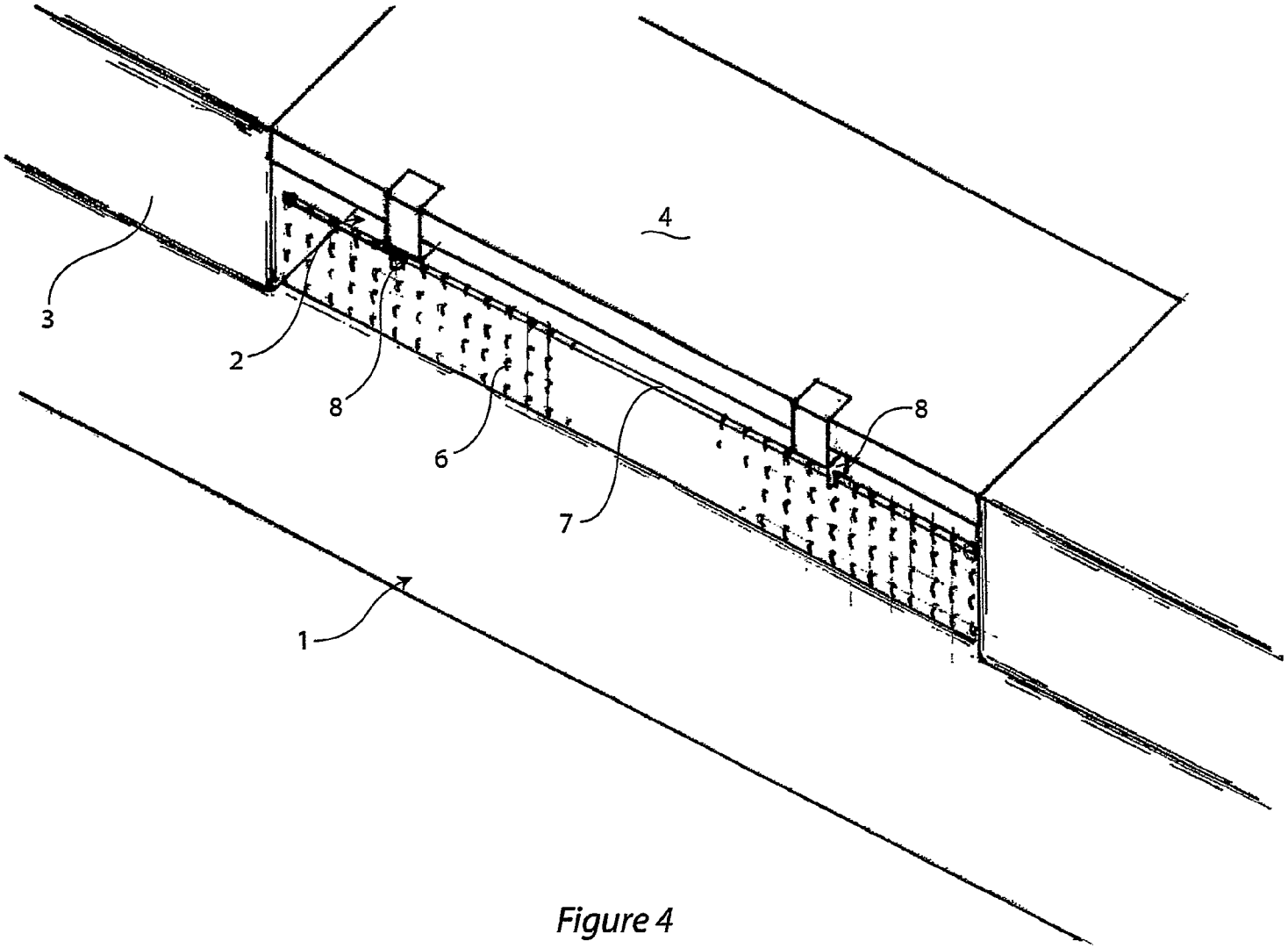
FIG. 4 is a general view of the screen of FIG. 1 attached to a side entry pit.

Referring to FIGS. 1 and 4, the side entry pit 1 has opening 2 in curb 3, the pit being covered by a removable cover 4. In this embodiment the skirt 5 has a plurality of galvanized chains 6 suspended from a spring steel rod 7 passing through holes in the vertical leg 8 of angle brackets 9. A channel shaped adjustable bracket 10 is clamped to the front edge 11 of the cover 4 by an adjustable screw 12 and lock nut 13. The horizontal leg 14 of the angle bracket 9 is clamped between the locknut 13 and the lower leg 15 of the channel shaped bracket 10. The lower ends of the chains are located against the bottom edge or water table 16 of the curb 3.

Side entry storm water pits vary in size and construction, and the support bracket can be made in the various popular sizes. The width of opening of the channel is such it can be installed over all known covers and clamped in position by the set screw. Also the support bracket can be provided with a telescopic portion to provide for different lengths of covers, the ends being clamped to fasten the support bracket in position.

Also it is preferred the chains be galvanised with a 5 mm clearance between the links to permit free passage of the water while still retaining the debris, the collection of large items of trash will not severely impede the water flow into the pit.

If it is necessary to conduct maintenance on the pit, the cover with the screen attached can be easily removed so that access is available to the pit for example to cleanout the smaller debris that passed through the chain screen. The chain screen permits cleaning of the gutter by a street sweeper, the screen permitting the brush to pass without damage to the screen or brush.

In use if there is a large backup of rubbish and water pressure created by the back up the fail safe chains can move into the pit opening and the rubbish is deposited in the pit. This prevents a large backup of water which may create flooding in adjacent areas. If in the unlikely event this occurs it is possible to remove the cover and clean out the pit.

It is thus seen that the screen is adjustable for various sized pits, the separate slotted brackets being suitable for damaged covers, the skirt being adjustable in width to suit various pit sizes.

In an alternate form the support bracket need not be continuous with one portion at each end of the cover, the end portions being clamped to the cover by the set screws.

As noted previously, it is sometimes necessary to prevent dirt, sand and gravel and the like from washing into a side entry pit. Dirt, gravel, sand and the like are often deposited on an established roadway due to flooding, earthworks on or adjacent the road, building operations, maintenance work on the road or footpath or adjacent areas, and it is desired to clean the roadway by washing.

Figure 5:
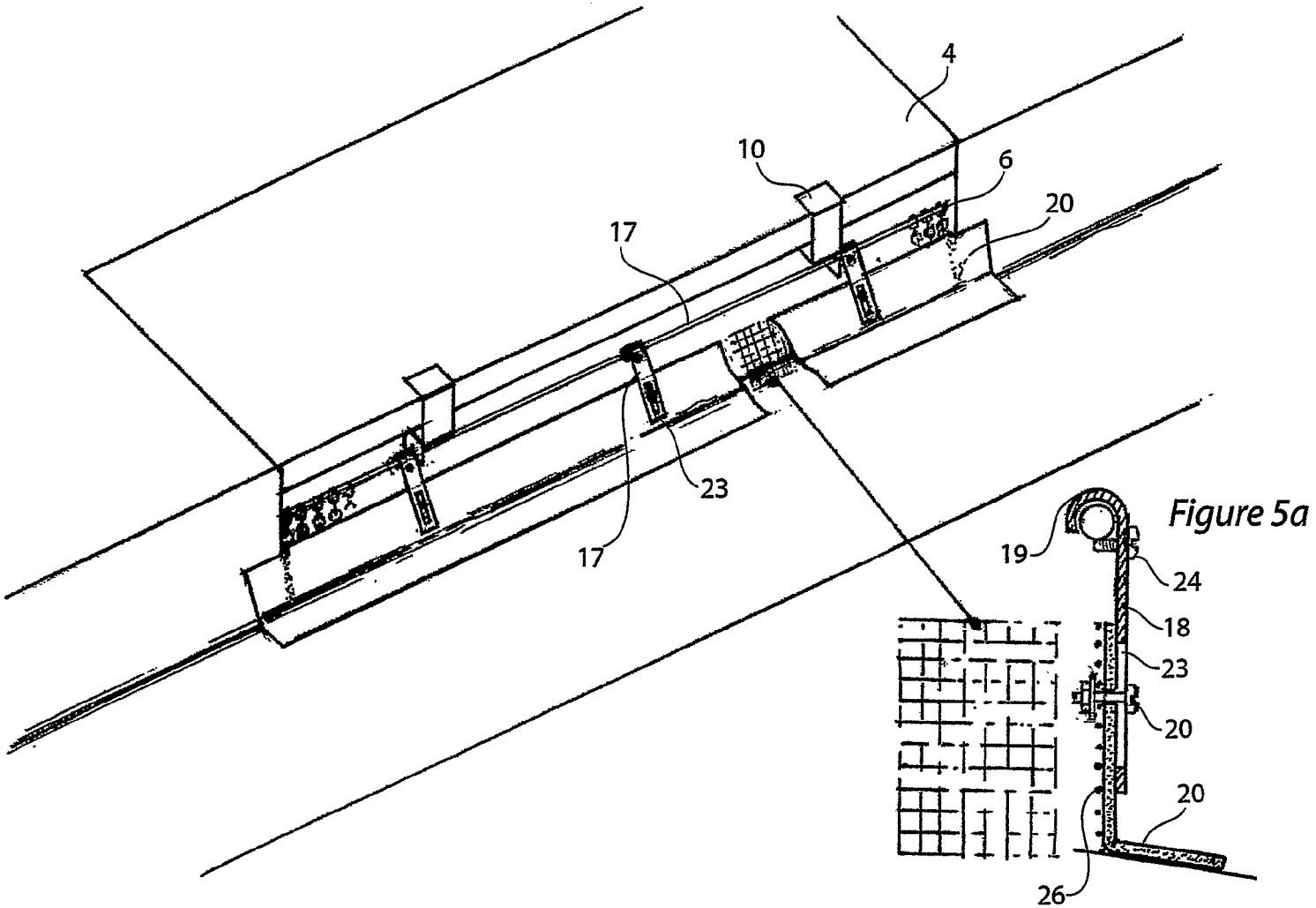

In the situation where a skirt above described is installed, it will be noted that sand, gravel and the like will be washed through the chain screen. A debris screen 17 shown in FIGS. 3 and 5 can be attached to the support rod 7. The screen 15 comprises a slotted metal hanger 18 having a hook shaped end 19 to hook over the support rod 7. The screen material of filter sponge 20 is supported by a steel mesh 21 preferably by gluing. The sponge material extends past the end of the steel mesh so that it extends outwardly of the pit on the water table 3, the steel mesh being in contact with the top surface 16 of the water table 3. The steel mesh and sponge material is adjustably positioned on the slotted bracket 17 by a nut and bolt 22 passing through slot 23. In use the screen is adjusted by the nut and bolt 22 so that the steel mesh rests on the surface 16 of the water table with the sponge material extending outwardly of the pit opening on the surface of the water table. A locating screw 24 in the hanger 18 locates the hanger on the support rod 7. In addition the skirt in length extends past the opening of the side entry pit.

The filter sponge 20 is a commercially available filter sponge, for example a filter sponge used in domestic air conditioning systems. This type of filter material prevents the passage of dirt and gravel and the like while permitting the water to pass through. However other forms of filter material may be used to prevent the passage of dirt and gravel in the pit while permitting water to pass through so there is not a bank up of water to any extent.

Figure 6:
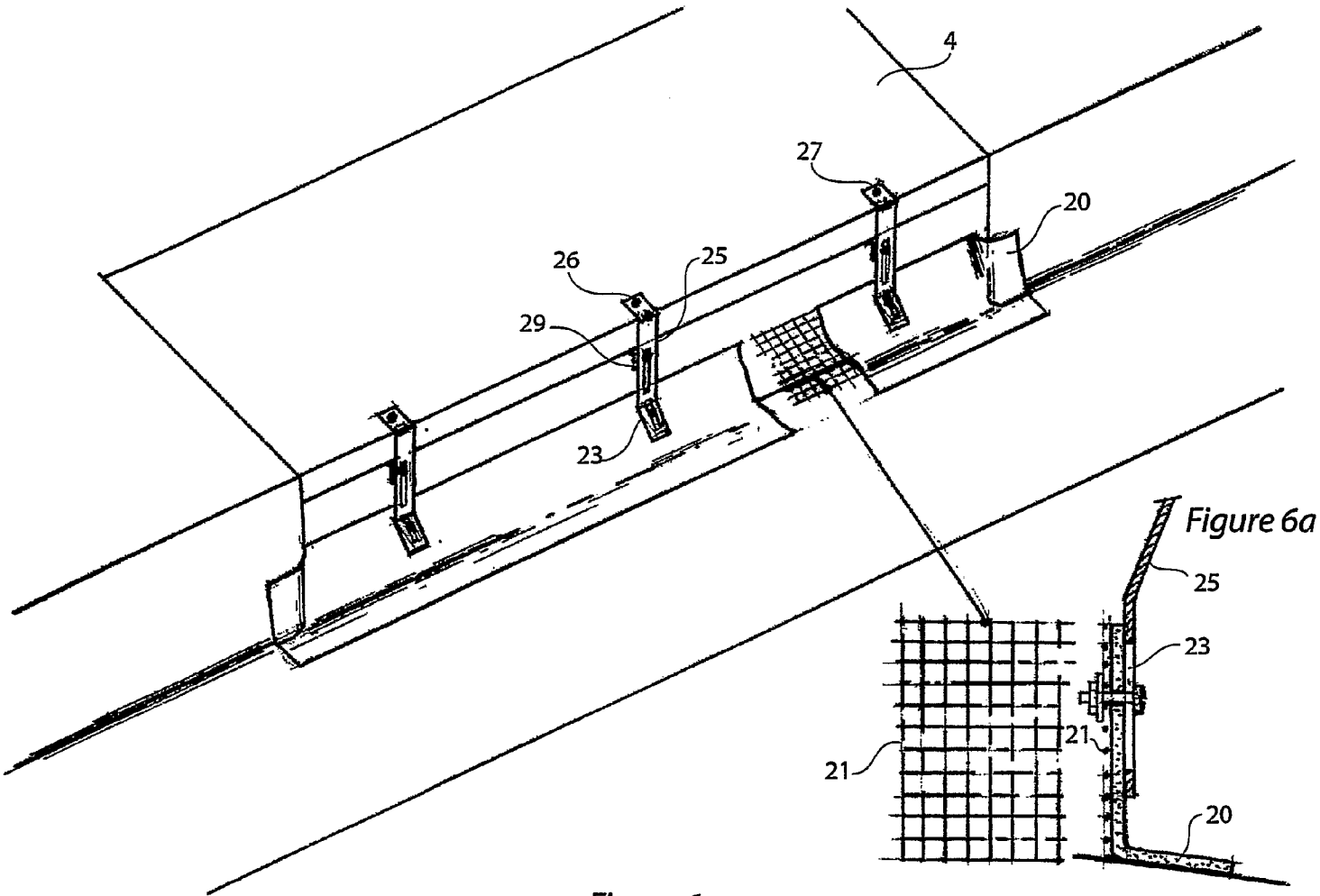

However in the instance where the trash skirt may not be fitted, particularly in situations where building operations are proceeding, such as in new development areas, a debris screen can be fitted direct to the cover of the side entry pit. An example of such debris screen is shown in FIGS. 3 and 6.

In this example the slotted bracket 25 holding the filter sponge and the mesh extends upwardly to be attached to the edge of the cover 4. The slotted bracket 25 has a flange 26 to extend over the edge of the cover 4, and is preferably located in position by a screw 27. An angle bracket 28 is positioned beneath the cover 4 and is adjustably positioned by a locking screw 30 in slot 29 in the bracket. The slot 29 provides adjustment of covers of varying thickness, and the screw 27 prevents the cover from slipping off the edge of the cover 4.

Figure 3:
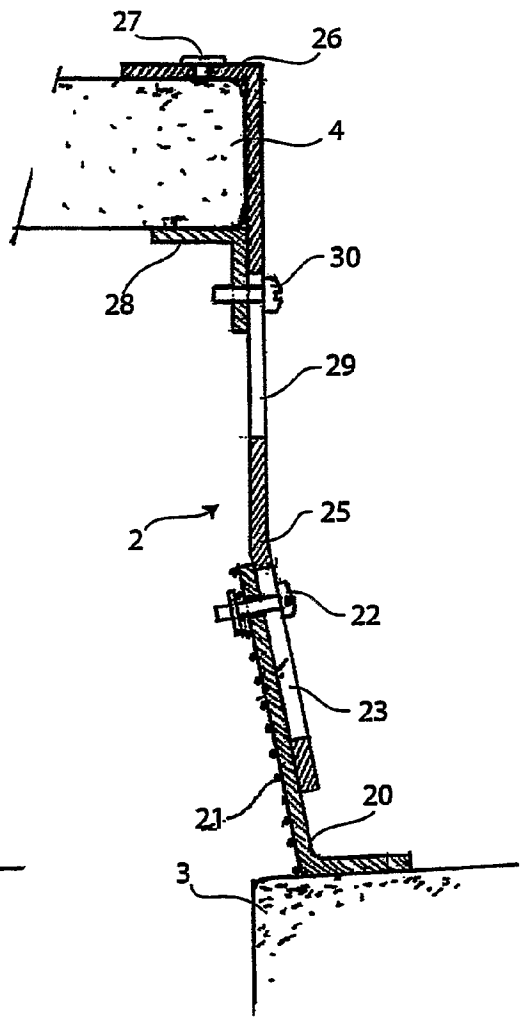
FIG. 3 is a side view of a third embodiment of the trash screen.
Figure 2:
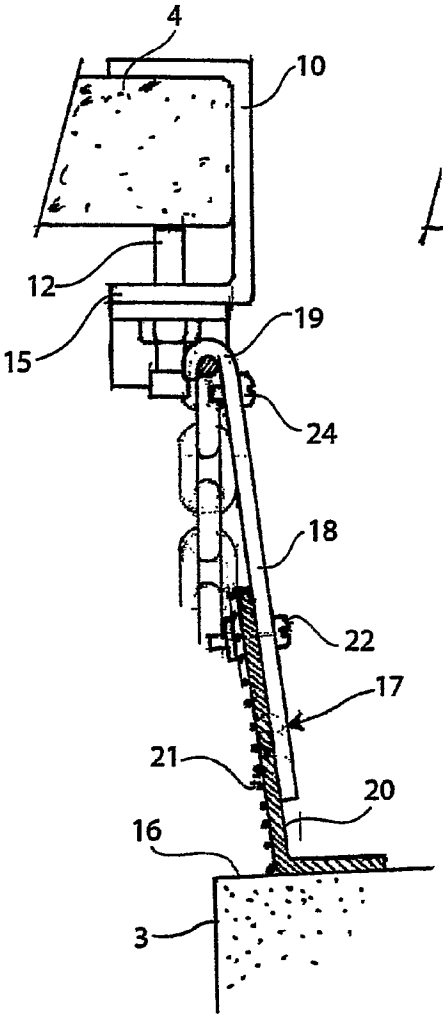
FIG. 2 is a side view of a further embodiment of the trash screen.

Although the debris screen of FIGS. 3 and 4 is designed with debris such as sand and gravel in mind, the debris screen will also prevent the entry of trash such as leaves and the like entering the side entry pit.

Thus it can be seen the invention provides protection for the side entry pit to substantially prevent trash and debris from entering the side entry pit, the skirt being provided for the trash and the screen for debris such as dirt and gravel.

Although the terms skirt and screen have been used to describe the two embodiments, it is to be realised that the terms are merely used to distinguish each other, but the terms can be used interchangeably, and either can be called a screen or a skirt.

Although various embodiments of the invention has been described in some detail it is to be realized the invention is not limited thereto but can include variations falling within the spirit and scope of the invention.

The invention claimed:

1. A system for the substantial prevention of trash and/or debris entering a street curbside side entry pit, said system comprising:

a frame adapted to be attached to the exposed edge of a cover of the side entry pit; and first screening means attached to said frame and depending across the opening of the side entry pit to at least the water table of the gutter containing the side entry pit, characterised in that the screening means are provided by a plurality of chains hanging across the opening to the side entry pit.

2. A system as defined in claim 1 and wherein said chains hang from a support rod in brackets attached to said frame.

3. A system as defined in claim 2 wherein the brackets are adjustable thus permitting the chains to be positioned as desired.

4. A system as defined in claim 3 wherein the chains extend across the opening of the side entry pit and extend to below the water table of the side entry pit to substantially prevent trash entering the side entry pit.

5. A system as defined in claim 2 wherein the chains extend across the opening of the side entry pit and extend to below the water table of the side entry pit to substantially prevent trash entering the side entry pit.

6. A system as defined in claim 1 wherein the chains extend across the opening of the side entry pit and extend to below the water table of the side entry pit to substantially prevent trash entering the side entry pit.

7. A system as defined in claim 1 wherein the screening means have a configuration to prevent substantial entry of trash such as foliage, paper and other material easily washed to the side entry pit.

8. A system as defined in claim 1 wherein the screening means include an additional screen to substantially prevent heavier materials such as dirt, sand or gravel washing into the side entry pit, said additional screen being attached in front of the first screening means, said additional screening means constructed to substantially prevent the entry of heavier materials into the side entry pit.

9. A system as defined in claim 8 wherein the additional screening means is of two part construction, an open mesh like member supporting a screening material to prevent the movement of heavier materials such as dirt, sand, gravel and the like therethrough.

10. A system as defined in claim 9 wherein the screening material is attached to the lower portion of the mesh-like member.

11. A system as defined in claim 8 wherein the additional screen may be attached directly to the free edge of the cover of the side entry pit.

12. A system for the substantial prevention of trash and/or debris entering a street curbside drain used in a curb opening catch basin side entry pit, said system comprising:

a frame adapted to attach to an exposed edge of a cover of the side entry pit; and first screen attached to said frame and depending across the opening of the side entry pit toward the water table of the gutter containing the side entry pit, the screen provided by a plurality of chains hanging across the opening to the side entry pit.

13. A system as defined in claim 12 wherein the chains extend across the opening of the side entry pit and extend to below the water table of the side entry pit to substantially prevent trash entering the side entry pit.

14. A system as defined in claim 12 wherein the screen includes an additional screen component to substantially prevent heavier materials such as dirt, sand or gravel washing into the side entry pit, said additional screen being attached in front of the first screen component, said additional screen element constructed to substantially prevent the entry of heavier materials into the side entry pit.

* * * * *